US005934715A

United States Patent [19]

Prevot et al.

[11] Patent Number: 5,934,715

[45] Date of Patent: Aug. 10, 1999

[54] ANTI-FALSE MANEUVER-TYPE SAFETY-DEVICE FOR A FITTING FOR LOCKING A LEAF

[75] Inventors: Gérard Prevot, Willerwald; Richard Strassel, Berthelming, both of France

[73] Assignee: Ferco International, Ferrures et Serrures de Batiment, Sarrebourg, France

[21] Appl. No.: 08/977,165

[22] Filed: Nov. 24, 1997

[51] Int. Cl.[6] ..... E05C 19/00

[52] U.S. Cl. ..... 292/1; 292/152; 292/163; 292/262; 292/277

[58] Field of Search ..... 292/170, DIG. 17, 292/DIG. 19, 157, 163, 262, 277, 1, 150, 152, DIG. 61, 128; 16/319, 324, 330, 348, 357

[56] References Cited

U.S. PATENT DOCUMENTS

| | | | |
|---|---|---|---|
| 41,064 | 1/1864 | Frick | 292/128 |
| 122,061 | 12/1871 | Robie | 292/170 |
| 893,702 | 7/1908 | Hayes | 292/174 |
| 3,066,964 | 12/1962 | Lemaire | 292/341.17 |
| 4,428,154 | 1/1984 | Rinehart | 292/277 |
| 4,624,075 | 11/1986 | Vigreux | 49/192 |
| 4,634,160 | 1/1987 | Lahmann et al. | 292/336.3 |
| 4,648,638 | 3/1987 | McKnight | 292/144 |
| 4,691,950 | 9/1987 | Mayer et al. | 292/269 |
| 4,714,284 | 12/1987 | Varlet | 292/91 |
| 4,836,588 | 6/1989 | Simoncelli et al. | 292/34 |
| 4,902,056 | 2/1990 | Prevot et al. | 292/335 |
| 5,076,015 | 12/1991 | Manzalini | 292/38 |
| 5,095,583 | 3/1992 | Prevot | 16/243 |
| 5,104,161 | 4/1992 | Kautt | 292/157 |
| 5,141,267 | 8/1992 | Vigreux | 292/95 |
| 5,141,272 | 8/1992 | Veillette | 292/338 |

FOREIGN PATENT DOCUMENTS

| | | | |
|---|---|---|---|
| 3604083 | 8/1987 | Germany | 292/262 |
| 2270337 | 3/1994 | United Kingdom | 292/32 |

*Primary Examiner*—Darnell M. Boucher
*Assistant Examiner*—Stephen Grady
*Attorney, Agent, or Firm*—Harrison & Egbert

[57] ABSTRACT

A safety device, of the anti-false maneuver type, capable of impeding the actuation of a locking fitting upon opening of a leaf of a door, window or the like, this safety device including, on the one hand, a support in the shape of a casing capable of being inserted against a face-plate and, on the other hand, a locking finger passing through this latter, under the action of springy restoration means, with a view to locking an actuating rod in translation, this when the door or window is open. In particular, the casing defined by the support and serving as a housing for the locking finger includes, at the level of each of its opposite sides parallel to the plane of the leaf on which it is fitted, an opening serving for the passing through of the connecting lug which is capable of being fitted onto the locking finger with a view to actuating same under the action of an actuating lug extending.

10 Claims, 3 Drawing Sheets

ANTI-FALSE MANEUVER-TYPE SAFETY-DEVICE FOR A FITTING FOR LOCKING A LEAF

BACKGROUND OF THE INVENTION (1) Field of the Invention

The invention relates to a safety device, of the anti-false maneuver type, capable of totally or partially impeding the actuations of a locking fitting, such as a casement bolt or a lock bolt, upon opening of a leaf of a door, window or the like, including, on the one hand, a support in the shape of a casing capable of being inserted against a face-plate on the rear side of which moves an actuating rod corresponding to the locking fitting and, on the other hand, a locking finger passing through said face-plate with a view to co-operating, under the action of springy restoring means, with the actuating rod, on this locking finger being capable of acting a connecting lug corresponding to a control organ, in order to bring same into an unlocking position under the action of another leaf or of the sash-frame of the door or window when closing this latter.

This invention will find its application in the field of the building iron-mongery. In addition, it particularly relates to the swinging and tilting leaves.

(2) Description of the Prior Art

Many locking fittings for doors, windows or the like authorize various ways of opening of the leaf or leaves this latter is comprised of. Thus, within the framework of swinging and tilting leaves, a first control exerted on the locking fitting in the shape of a casement bolt or a lock bolt allows the opening of the door or window through pivoting of its leaf or of one of its leaves about a vertical axis of rotation, often called opening in the French way. On the other hand, when continuing the motion initially imparted to the casement bolt or the lock bolt, this leaf opens as a tilting leaf, i.e. by pivoting about a horizontal axis substantially embodied by the lower rail of the sash-frame. One obviously understands that these various ways of opening involve the hinged fittings on which is capable of acting the locking fitting with a view to immobilizing the leaf or, on the other hand, to releasing the leaf in either way of opening.

Furthermore, in order to avoid the opening of the leaf, called in the way of a flag, it is absolutely necessary to impede the actuation of the locking fitting when this leaf is in any of its open positions. This can indeed cause the deterioration of the control and hinging fittings of the leaf. In addition, this gives rise to an uncomfortable position of the leaf requiring a manipulation which is not less uncomfortable, in order to return into the right initial closed position of the frame of the leaf within the sash-frame.

To this end have been contrived the safety devices, which are also called anti-faulse-maneuver devices, which are in many cases housed directly in the casing containing the control mechanism for the locking fitting of the casement-bolt or lock-bolt type. As a matter of fact, such a safety device thus seriously complicates this mechanism and frequently calls in question many elements of the locking fitting.

Furthermore, there are known safety devices capable of being inserted against a face-plate provided for in the fillister of a leaf and covering an actuating rod corresponding to a casement bolt or lock bolt. Such a safety device includes a support which is, as a matter of fact, secured to the face-plate, while a locking finger passes through an opening provided for in this latter, with a view to co-operating, under the action of springy restoring means, with the actuating rod and, thus, in order to immobilize this latter when the leaf is in anyone of its open positions. In this respect, the safety device includes, in addition, a control organ provided with an actuating lug on which is capable of acting, as the case may be, the sash-frame or another leaf of the door, window or the like, when closing this latter. Thus, the function of this control organ, through a connecting lug, is to bring the locking finger, under such circumstances, into its inactive position, i.e. released from the actuating rod.

Accordingly, only when fully closing the leaf provided with the safety device, the actuating rod is again released and, therefore, the locking fitting of the casement-bolt or lock-bolt type can be operated.

The drawback of such a safety device resides in its complexity.

In particular, the control organ is in the shape of a blade bent back so as to define, on the one hand, the actuating lug on which, as a matter of fact, acts the sash-frame or any other obstacle which is in its way when closing the leaf and, on the other hand, the connecting lug. As a matter of fact, this latter is provided for to cause a shoe, capable of pushing back a blade tiltingly fitted in the casing defined by the support, to pivot about an axis parallel to the face-plate. At its opposite end with respect to its axis of tilting, this blade is engaged on the locking finger capable of moving perpendicularly to the plane of the face-plate. The springy restoring means, in the shape of a spring, push on this locking finger to systematically restore same into its active position, so that right from the opening of the leaf, the control organ releasing its action on the shoe and, thus on the blade, this locking finger can co-operate with the actuating rod, with a view to immobilizing same in translation.

Thus, besides the bent blade defining the control organ, this safety device necessarily includes:

- a shoe pivotingly fitted on the support,
- a blade which is, in turn, tiltingly fitted, by means of an adequate insert, in the casing defining this support,
- and, of course, the locking finger and its springy restoring means.

Its necessary not only to manufacture these numerous parts, but they must also be assembled. The whole is also relatively voluminous, whereby it should be known, in this respect, that it has to be positioned in the fillister of a leaf of a door, window or the like.

Such a safety device has furthermore been designed to be reversible. First of all, the shoe can pivot in either direction about its axis of rotation. Such a pivotment causes, in all cases, the tilting of the blade acting on the locking finger. In addition, the conrol organ is pivotingly fitted on the shoe it has to actuate. Under such circumstances, the actuating lug of this control organ can be located on either side of the safety device, making possible its use on a leaf opening to the right or to the left.

However, the rotation of the control organ should not be freely possible. Therefore, the connecting lug has to be crimped onto the shoe with some crimping force authorizing, as a matter of fact, this rotation only when same is wanted by the carpenter securing the fitting of a door, window or the like.

In addition it should be observed that the complexity of such devices makes their reliability questionable. Too much backlash due to the numerous parts, associated with the changes of the fillister and the kind of construction itself, cannot fully guarantee the right operation of the device.

SUMMARY OF THE INVENTION

This invention is meant to be capable of bringing a solution for these problems, on the one hand, by means of the design of a simple safety device including a minimum of parts and of a size as small as possible and, on the other hand, the control organ of which, aimed at directly acting on the locking finger, can be inserted by the carpenter, through a mere fitment, on the safety device when providing a leaf of a door, window or the like with fittings. As a matter of fact, this avoids the presence of this control organ on this safety device during its transportation and its keeping in the warehouse, not to mention the fact that it is easy for the carpenter to adapt the position of this control organ according to the direction of opening of the leaf to be provided with such a safety device.

To this end, the invention relates to a safety device, of the anti-false-maneuver type, capable of totally or partially impeding the actuations of a locking fitting, such as a casement bolt or a lock bolt, upon opening of a leaf of a door, window or the like, including, on the one hand, a support in the shape of a casing capable of being inserted against a face-plate on the rear side of which moves an actuating rod corresponding to the locking fitting and, on the other hand, a locking finger passing through the face-plate with a view to co-operating, under the action of springy restoring means, with the actuating rod, on this locking finger being capable of acting a connecting lug corresponding to a control organ in order to bring same into an unlocking position under the action of another leaf or of the sash-frame of the door, window or the like when closing this latter, characterized in that the casing defined by the support and serving as a housing for the locking finger includes, at the level of each of its opposite sides parallel to the plane of the leaf on which it is fitted, an opening serving for the passing through of the connecting lug which is capable of being fitted into this casing and onto the locking finger with a view to actuating same under the action of an actuating lug extending the connecting lug, this latter being furthermore provided with means for anchoring in the casing.

Thus, one first of all notices that the control organ directly acts on the locking finger. In addition, this control organ can be firmly inserted into the casing which is defined, in combination, by the support and its cover, this at the very moment of fitting the safety device on the leaf the direction of opening of which is furthermore known. It should be noted, in this respect, that because he is obliged to ensure the fitting of this control organ, the carpenter necessarily has his attention drawn on its right positioning. Thus, in the former case in which the safety device was pre-provided with this control organ, this carpenter could inadvertently forget to check that the control organ is in a position adapted to the direction of opening of the leaf. Under such circumstances, the error was detected only during the first handling of the door, window or the like.

The attention is drawn on the fact that such a safety device can be inserted against the face-plate of the locking fitting by means of a fixing organ which passes through, on the one hand, this face-plate and, on the other hand, the actuating rod arranged at the rear side. In order to authorize the free movement of this latter, same compulsorily includes an elongated opening in front of this fixing organ. Now, because of, on the one hand, the amplitude of displacement of this actuating rod to pass over from its position corresponding to the locking of the door, window or the like to the position of tilted opening of the leaf, and this passing through the opening in the French way, and, on the other hand, the generally reduced size of this safety device from which results the vicinity of the fixing organ with respect to the locking finger, this latter generally locating itself, in only one open position of the leaf, in a hole in the rod impeding this latter from moving in any direction, while, in the other open position, this locking organ penetrates into the elongated slot of the rod which, actually, serves for the passing through of the fixing organ. This results into the fact that in this second position, this actuating rod can be immobilized through this locking finger only in one of its directions of displacement.

Actually, though such a safety device allows to impede the passage over from the open position in the French way of the locking fitting to the tilted open position and reversely, as long as the leaf is not closed against the sash-frame, it is often impossible for same to impede this fitting from passing over from the open position in the French way to the locked position, even when this leaf is half open.

Therefore, this invention in addition relates to a safety device capable of completely impeding the actuations of a locking fitting, such as a casement bolt or a lock bolt, when the leaf on which it is fitted is in any of its open positions.

To this end, the invention also relates to a safety device the support of which is inserted against the face-plate by means of a fixing organ, such as a screw or the like, passing through said face-plate as well as an elongated slot in the actuating rod in order to co-operate with the joinery of the leaf, characterized in that it has a symmetrical configuration with respect to the transversal median plane and includes a second locking finger passing through said face-plate with a view to co-operating, under the action of springy restoring means, with the actuating rod, on this locking finger acting a second connecting lug associated with a control organ, the distance between the axes of the locking fingers being so determined that either at least one of these latter co-operates with an opening with a closely fitting cross-section provided for in the actuating rod when the locking fitting is brought into any of the open positions of the leaf, this with a view to ensuring a bidirectional immobility of the rod, or that, in one of the open positions, one of the locking fingers co-operates with an opening with a closely fitting cross-section, so as to immobilize the actuating rod in each of its directions of displacement and, in the other open position, both locking fingers engage at the level of the ends of the elongated slot present in the actuating rod and serving for the passing through of the fixing organ connecting the safety device to the leaf, in order to immobilize the actuating rod in translation.

Further aims and advantages of this invention will become clear during the description which follows and which relates to embodiments and which will be better understood when referring to the attached drawing.

DESCRIPTION OF THE PREFERRED EMBODIMENTS

Figure 1:
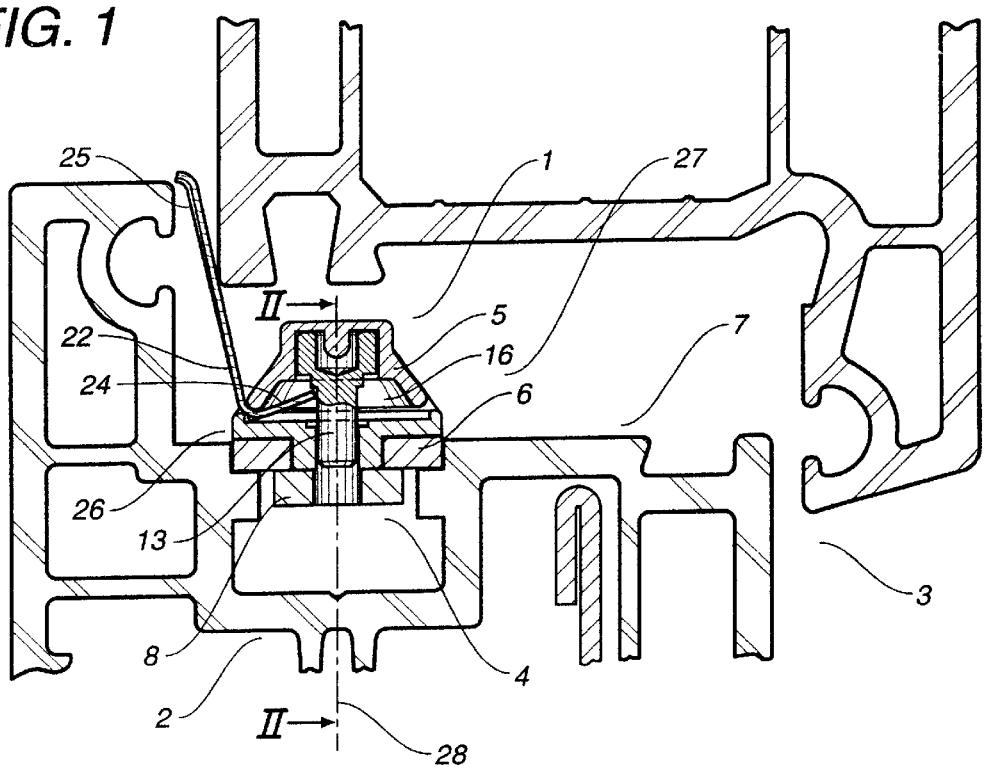
FIG. 1 is a schematical and cross-sectional view of the safety device one of both leaves of a closed window, in particularly the one including a locking fitting of the casement-bolt or lock-bolt type, is provided with, FIG. 2 is a schematical and cross-sectional view along II—II of FIG. 1.
Figure 2:
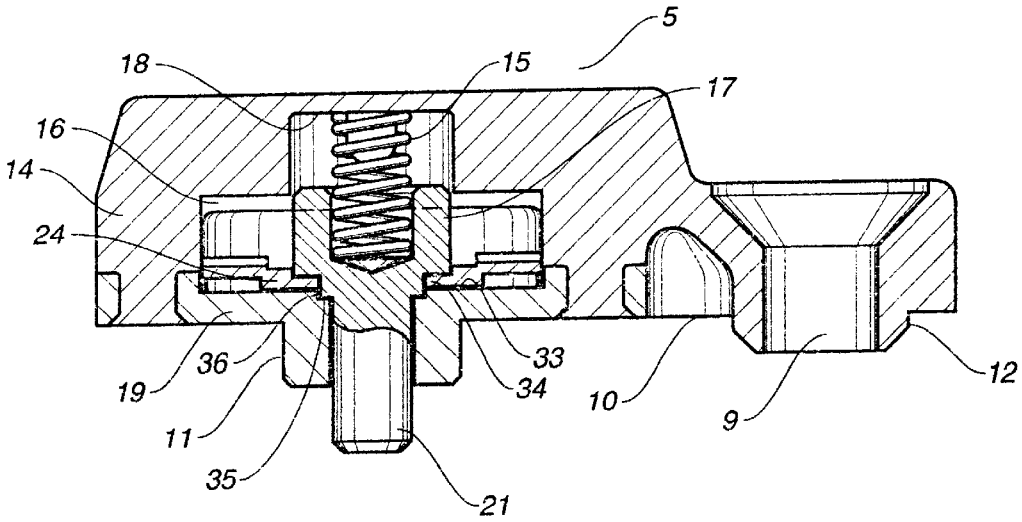
Figure 3:
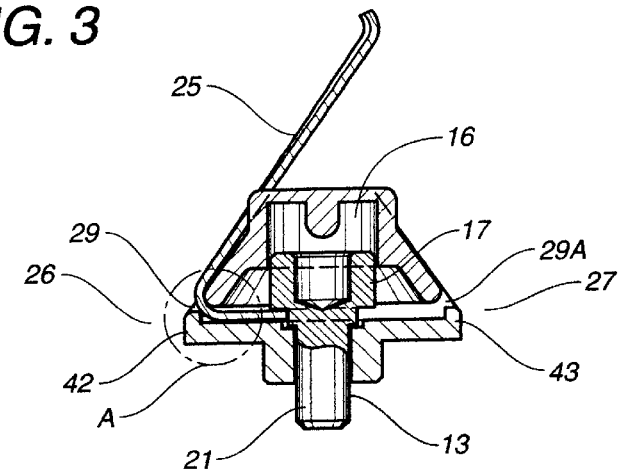
FIG. 3 is a schematical and elevational view of the safety device as shown in FIG. 1, the action on the control organ being here released so that the locking finger is brought into its locking position.
Figure 4:
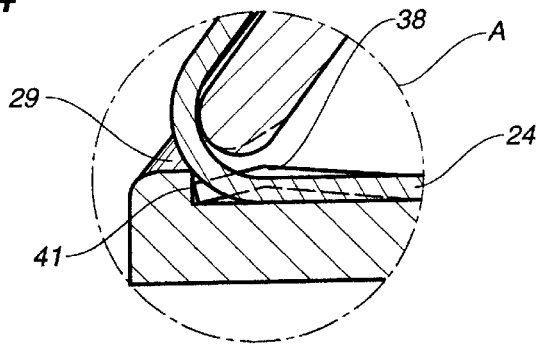
FIG. 4 is a view of detail A of FIG. 3.
Figure 5:
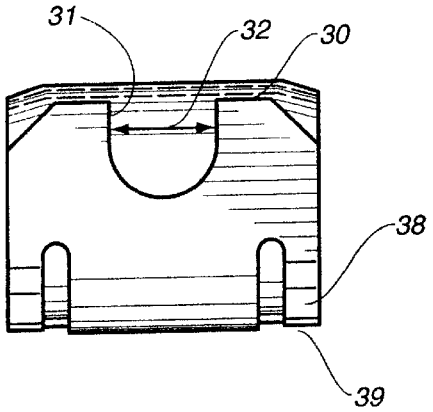
FIG. 5 is a view from below of the connecting lug corresponding to the control organ.
Figure 6:
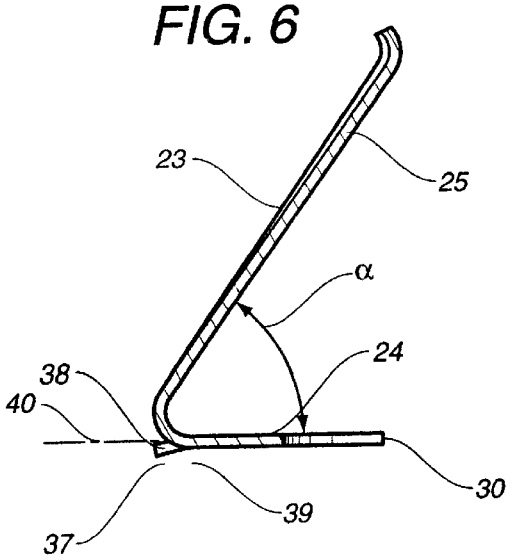
FIG. 6 is a schematical and cross-sectional view of this control organ.
Figure 7:
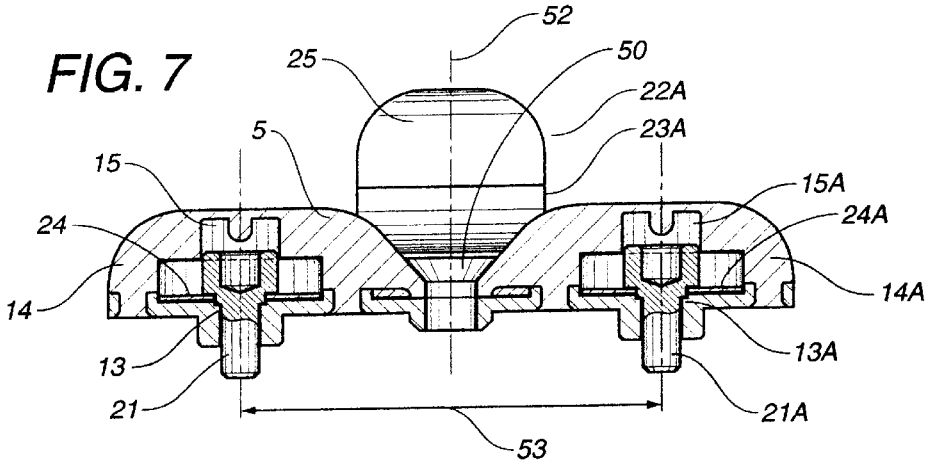
FIG. 7 is a schematical and longitudinal sectional view of a safety device having a symmetrical configuration with respect to its transversal median plane and, therefore, including two locking fingers.
Figure 8:
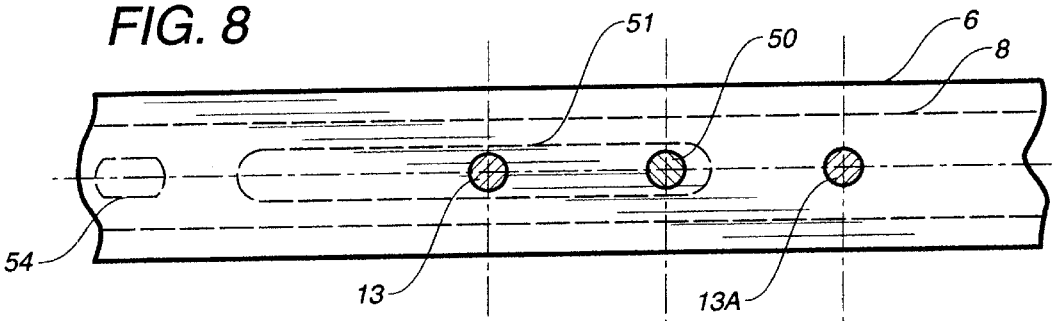
FIG. 8 shows the position of these two locking fingers with respect to the actuating rod when the locking fitting of the casement-bolt or lock-bolt type is in the locking position.
Figure 9:
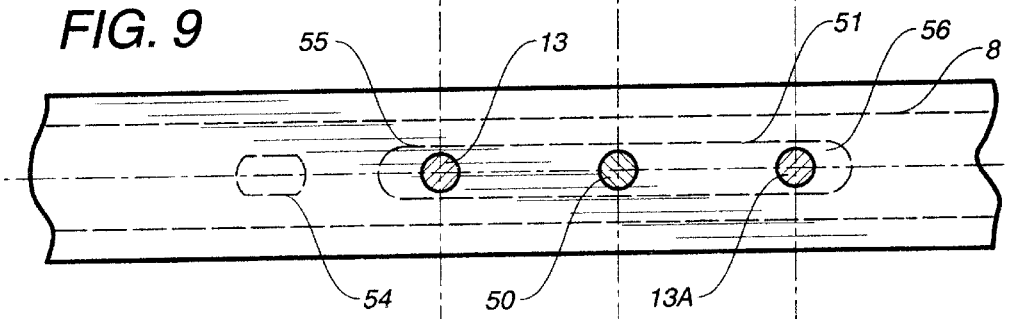
FIG. 9 is an illustration similar to FIG. 8, showing the position of both locking fingers engaged in an elongated slot provided for in the actuating rod, this when the locking fitting is brought into its first position of opening of the leaf, usually corresponding to the opening in the French way of this latter.

As shown in FIGS. 1 through 3 of the attached drawings, this invention relates to a safety device 1, of the anti-false maneuver type, aimed at being fitted on a leaf 2 corresponding to a door, window or the like 3, provided, furthermore, with a locking fitting, such as a casement bolt or a lock bolt 4. As a matter of fact, the function of such a safety device 1 is, in particular, to impede the actuation of this locking fitting 4 when said leaf is in any of its open positions. Thus, by way of an example, this safety device 1 allows, in the case of a swinging-tilting-type leaf, to avoid to be able, under the action of the locking fitting, to control the tilting opening of this leaf, even though it is already half open through rotation about its vertical pivotment-axis called, for reasons of easiness of the description, opening in the French way. Moreover, such a safety device 1 can simply impede this locking fitting from being brought into its locking position when the leaf is open. If this would happen to occur, the locking organs, such as rollers, catches or the like would indeed strike, as the case may be, against the sash-frame or the other leaf of the window and could not position themselves in front of their corresponding keeper. In the long run, such repeated shocks may produce the dysfunctioning of the locking fitting.

As a matter of fact, the safety device 1 meant here includes a support 5 capable of being inserted against a face-plate 6 arranged in the fillister 7 of the leaf 2 and at the rear side of which has to move an actuating rod 8 corresponding to the locking fitting of the casement-bolt or lock-bolt type 4. Thus, this support 5 includes at least a hole 9 serving for the passing through of a fixing organ, such as a screw, which passes through the face-plate 6 as well as through the actuating rod 8, to penetrate into the joinery.

It should be noted that said actuating rod 8 includes, in front of the hole 9, an elongated slot authorizing its free axial travel with respect to the fixing organ. On the back face 10 of this support 5 can, in addition, be seen positioning embosses 11, 12 aimed at co-operating with openings with a closely fitting cross-section provided for at the level of the face-plate 6 in order to perfectly position the safety device 1 on this latter. It should be noticed that when the device has only one fixing screw and two positioning embosses, according to the embodiment shown, this is an advantage for the carpenter whose task is made easier during the fitting, since the securing and the positioning of this device are carried out without any particular care. As will appear later in the description, the control organ of this device is indeed fitted last.

This invention is in no way limited to such means for securing and positioning the safety device 1 on a face-plate 6, whereby it should be known that other solutions, such as by rivetting or the like, could of course also be contemplated.

Furthermore, this safety device 1 includes a locking finger 13 arranged in the casing 14 which is advantageously defined by the support 5, this locking finger 13 passing through the face-plate 6, with a view to co-operating, under the action of springy restoring means 15, with the actuating rod 8.

Thus, as can be seen in FIGS. 1 through 3, the locking finger 13 extends perpendicularly to the plane of the face-plate 6. In addition, in the housing 16 of the casing 14 defined by the support 5, this locking finger 13 includes a head 17, with a larger cross-section, on which act these springy restoring means 15 in the shape of a helical spring which, as a matter of fact, interposes itself between this head 17 and the bottom 18 of the housing 16. It should be noticed that this latter is closed, at the back face 10 of the support 5, by means of a cover 19, preferably crimped onto this latter, and perforated with an opening 20 serving for the passing through of and for guiding the active portion 21 of the locking finger 13.

Finally, on this latter is capable of acting a control organ 22 the function of which is to bring same into locking position when closing the leaf 2, this under the action, as the case may be, of the other leaf corresponding to the door or window 3 or simply of the sash-frame of this latter.

Thus, as can be seen in the various FIGS. 1 through 6, this control organ 22 is in the shape of a blade 23, preferably made of a springy material, which, as can be seen in FIGS. 1, 3, 5 and 6, is bent back so as to define a connecting lug 24 aimed, in particular, at co-operating with the locking finger 13 and an actuating lug 25. This latter defines, with respect to the connecting lug 24, an angle $\alpha$ which, as will be explained later in the description, is preferably of the acute type.

As a matter of fact, according to the invention, the casing 14 corresponding to the support 5 includes, at the level of each of its opposite sides 26, 27 parallel to the plane 28 of the leaf 2, an opening 29, 29A, viz. in the shape of a slot, serving, as a matter of fact, for the passing through of the connecting lug 24 corresponding to the control organ 22. These openings 29, 29A thus allow this connecting lug 24 to fit onto the locking finger 13.

In particular, said connecting lug 24 includes, at the level of its front edge 30, a cut-out 31 of a width 32 slightly smaller than the cross-section of the head 17 of the locking finger 13, so as to be capable of engaging onto this latter, under this head 17.

It should be noticed that in order to facilitate this fitment of the connecting lug 24, it is necessary to preserve, between this head 17 of the locking finger 13 and the face 33 of the cover 19, internal to the housing 16, a space 34 corresponding at least to the thickness of said connecting lug 24. For this purpose, the active portion 21 of the locking finger 13 has, substantially at the level of its junction with the head 17, a shoulder 35 aimed at resting, as the case may be, either directly against this internal face 33 of the cover 19 or on the bottom of a bore 36 provided for in this latter. This latter configuration corresponds, in particular, to the embodiment shown in the drawings.

It should in addition be noticed that according to the invention this connecting lug 24 of the control organ 22 is provided with means 37 for anchoring in the casing 14.

According to an advantageous embodiment, these anchoring means 37 are in the shape of a member forming a set-back provided for at the level of this connecting lug 24 and impeding the withdrawal of same from the casing 14 once it has been engaged into this latter. Thus, as shown in the drawings, these anchoring means 37 can be in the shape of at least a blade 38 defined through cutting out at the rear edge 39 of this connecting lug 24, this blade 38 thus being bent back under the plane 40 of this latter, so as to form a set-back aimed at co-operating with a rim 41 accordingly provided for at the level of the casing 14. In particular, this rim 41 is located at the level of the openings 29, 29A in the shape of slots present at the level of the sides 26, 27 of the casing 14. As a matter of fact, these rims 41 are provided for at the level of the inner face 33 and at the level of the edges 42, 43 corresponding to the cover 19 and locating themselves in correspondance with the sides 26, 27 of the casing 14. Advantageously, this cover 19 has a substantially square shape symmetric with respect to its center corresponding to the opening 20 for the passing through of the locking finger 13. This avoids any positioning error when crimping this cover 19 onto the back face 10 of the support 5.

Turning back to the control organ 22, as already stated above, its actuating lug 25 forms an acute angle a with respect to the connecting lug 24. This allows same to be engaged sufficiently early by, as the case may be, the sash-frame or another leaf of the door or window 3, as a matter of fact when closing the leaf 2 provided with the safety device 1. It is indeed necessary to guarantee that the locking finger 13, under the action of this sash-frame or this other leaf and once the door or window 2 has been closed, be brought into its unlocking position.

In addition, it is also advantageous that the blade this control organ is comprised of be of a springy nature allowing said connecting lug 24 and the actuating lug 25 to form a varying angle a in some way adaptable to the changes in dimensions which can exist as regards the backlashes between the fillisters of two leaves or between a leaf and the sash-frame of a door, window or the like.

In order to better understand the following portion of the description, reference should be made in particular to FIGS. 7 through 10 of the attached drawings. In particular, it should be noted that a device 1 as described above is usually inserted against the face-plate 6 by means of a fixing organ 50, such as a screw, rivet or the like, passing, as a matter of fact, through this face-plate 6 as well as through the actuating rod 8 arranged at the rear, to engage into the joinery. As a matter of fact, in front of this fixing organ 50 this actuating rod 8 necessarily includes an elongated slot 51 the length of which is determined so as to allow the free travel of this actuating rod 8 with respect to this fixing organ 50, with a view to reaching the various open positions of the leaf, this starting from the locked position.

One observes that in this case a safety device 1 including only one locking finger 13, which is furthermore very near to the fixing organ 50, does not allow to ensure the immobility in translation of the actuating rod 8 in each of the open positions of the leaf 2. Indeed, in one of the positions adopted by the actuating rod, the locking organ, instead of being located in front of an opening with a closely fitting cross-section, engages into the elongated slot 51 which allows it to only partially fulfill its role.

Therefore, according to the invention, the safety device 1 has, in this variant of embodiment, a configuration symmetric with respect to a transversal median plane 52. Under such circumstances, it includes a second locking finger 13A arranged in a second casing 14A defined by the support 5. This locking finger 13A passes also through the face-plate 6, with a view to co-operating, under the action of springy restoring means 15A, with the actuating rod 8. In addition, on this locking finger 13A is capable of acting a second connecting lug 24A of a control organ 22A. As a matter of fact, according to a preferred embodiment, this latter is in the shape of a blade 23A, made of a springy material, which upon bending defines, on the one hand, two connecting lugs 24, 24A aimed at co-operating with a locking finger 13, 13A, respectively, and, on the other hand, one single actuating lug 25.

As a matter of fact, according to the invention, the distance 53 between the axes of the locking fingers 13, 13A is thus so determined that either at least one of these locking fingers 13, 13A co-operates with an opening 54 with a cross-section closely fitting the one of the active portion 21, 21A of this locking finger 13, 13A, this when the locking fitting, viz. the casement bolt or the lock bolt 4, is brought into any of the open positions of the leaf 2, with a view to ensuring, as a matter of fact, the bidirectional immobility of the actuating rod 8.

Figure 10:
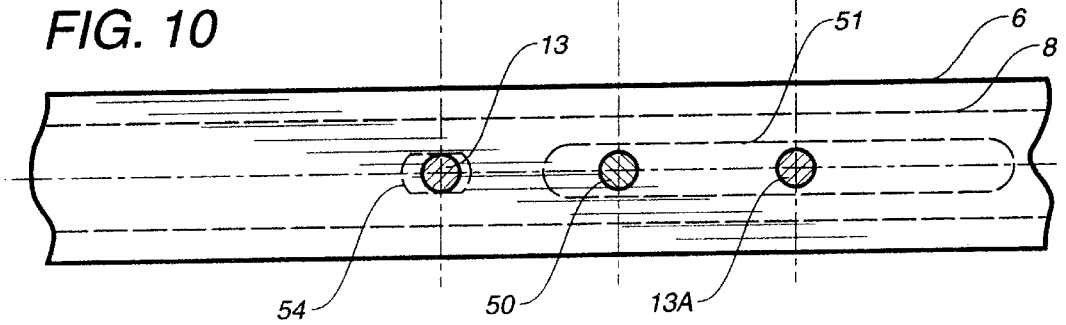
FIG. 10 is an illustration similar to FIGS. 8 and 9, showing the position of both locking fingers with respect to the actuating rod when the locking fitting is brought into the position of tilted opening of the leaf.

According to another variant of embodiment shown in particular in FIGS. 7 through 10, this distance 53 between the axes of the locking fingers 13, 13A is so determined that, in one of the open positions of this leaf 2, one 13 of the locking fingers co-operates with an opening 54 with a closely fitting cross-section, so as to immobilize the actuating rod 8 in each of its directions of displacement, while, in the other open position, both locking fingers 13, 13A engage at the level of the ends 55, 56 of the elongated slot 51 present in the actuating rod 8 and normally serving for the passing through of the fixing organ 50. This latter case is in particular shown in FIG. 9 and corresponds to the position taken by the actuating rod of the casement bolt or a lock bolt when same is brought into its position corresponding to the opening of the leaf 2 in the French way. In particular, in FIG. 8 can clearly be seen the position of this actuating rod with respect to the locking fingers 13, 13A when the casement bolt or lock bolt 4 is in the locking position. On the other hand, in FIG. 10 showing the position adopted by the actuating rod when the leaf 2 opens in the tilted way, the engagement of the locking finger 13 into the opening 54 is visible.

Finally, from the preceding description one notices that the safety device 1 according to the invention not only solves a problem of complexity and cost through a number of parts reduced to a minimum, but, in addition, a problem of safety, since it is finally capable of guaranteeing a perfect immobility of the actuating rod of a casement bolt or a lock bolt in any open position of the leaf. Thus, through this safety device, it is now impossible to actuate the locking fitting to pass over from the open position in the French way to the tilted open position or reversely, but also with a view to bringing same back into its locking position and this as long as the leaf is not closed against the sash-frame.

What is claimed:

1. A safety device for impeding an action of a lock bolt, the safety device comprising:

a leaf;

a support member defining a casing, said support member inserted onto a faceplate, said faceplate having an actuating rod positioned on an opposite side of said faceplate from said support member, said casing having opposing sides in parallel relation to a plane of said leaf, a locking finger extending through said faceplate so as to cooperate with said actuating rod, said locking finger being resiliently mounted within said support member so as to be urged toward said actuating rod, said locking finger being housed within said casing; and a control organ means having a connecting lug affixed to said locking finger, said control organ means being cooperative with said locking finger for moving said locking finger between a locking position to an unlocking position upon contact with another leaf or with a sash frame, said connecting lug extending through an opening formed on at least one of said opposing sides, said control organ means having an actuating arm connected to said connecting lug, said actuating arm extending outwardly of said casing, said connecting lug having an anchor engaged within said casing.

2. The safety device of claim 1, said faceplate defining a plane through which said locking finger extends, said locking finger having a head formed thereon of greater diameter than a remainder of said locking finger, the safety device further comprising:

a springy restoring means for providing the resilient mounting of said locking finger, said springy restoring means being a helical spring, said locking finger having an active portion passing through a hole formed in a cover attached to said faceplate, said cover being crimped onto said support member.

3. The safety device of claim 1, each of said openings being a slot through which said connecting lug of said control organ means passes.

4. The safety device of claim 1, said locking finger having a head of a larger diameter than a remainder of said locking finger, said connecting lug of said control organ means having a front edge with a cutout formed therein, said cutout having a width slightly smaller than said diameter of said head, said cutout engaging said locking finger below said head.

5. The safety device of claim 1, said locking finger having a head of a larger diameter than a remainder of said locking finger, said head receiving a spring therein, said locking finger having an active portion passing through a hole formed in a cover attached to said faceplate, said cover having an internal face, said active portion of said locking finger having a junction with said head, said locking finger having a shoulder residing adjacent said internal face so as to define a space between said shoulder and said internal face, said space receiving said connecting lug of said control organ means.

6. The safety device of claim 1, said anchor defining a set-back from said connecting lug, said set-back retaining said connecting lug within said casing.

7. The safety device of claim 1, said connecting lug being positioned within a plane, said connecting lug having a rear edge, said anchor having a shape of a blade cutout from said rear edge, said blade being bent back below said plane of said connecting lug, said blade forming a set-back engaged with a rim formed adjacent said openings of said casing, said openings of said casing being slots, said support member having a back face having a cover crimped thereonto, said cover having an inner face with outer edges, said rim positioned at said inner face adjacent and inward of said outer edges.

8. The safety device of claim 1, said support member having a back face onto which a cover is crimped, said cover being of a substantially square shape, said cover having a hole in a center thereof, said locking finger extending through said hole.

9. The safety device of claim 1, said support member being attached by a fixing organ to said faceplate, said fixing organ passing through said faceplate, said actuating rod having an elongated slot formed therein, said fixing organ passing into said elongated slot, the safety device further comprising:

a second locking finger passing through said faceplate so as to be cooperative with said actuating rod, said second locking finger being resiliently mounted within said support member such that said second locking finger is urged toward said actuating rod; and a second control organ means having a connecting lug engaging said second locking finger, said first and second locking fingers having a distance between axes thereof, said distance being such that at least one of the locking fingers cooperates with an opening in said actuating rod when said leaf is moved to an open position, said second control organ means for causing one of said locking fingers in said opening in said actuating rod to be engaged so as to immobilize said actuating rod.

10. The safety device of claim 9, one of said control organ means having a shape of a blade, said blade being of a springy material, said blade defining a first connecting lug and a second connecting lug, said first and second connecting lugs cooperating with the locking fingers respectively, said control organ means having a single actuating lug portion connected to said first and second connecting lugs and extending outwardly of said casing.

* * * * *